United States Patent [19]

Daniels, Jr.

[11] Patent Number: 5,007,591

[45] Date of Patent: Apr. 16, 1991

[54] ICE SHAVER APPARATUS

[76] Inventor: Thomas E. Daniels, Jr., 917 E. 9140 South, Sandy, Utah 84094

[21] Appl. No.: 465,907

[22] Filed: Jan. 12, 1990

[51] Int. Cl.[5] ..... B02C 18/00; B02C 19/08

[52] U.S. Cl. ..... 241/37.5; 241/169.1; 241/DIG. 17; 241/282.1

[58] Field of Search ..... 241/37.5, 168, 169.1, 241/92, 95, 199.1, 199.5, 278 R, 279, 280, 281, 282.1, DIG. 17

[56] References Cited

U.S. PATENT DOCUMENTS

| | | | |
|---|---|---|---|
| 2,627,377 | 2/1953 | Fletcher | 241/DIG. 17 X |
| 3,679,140 | 7/1972 | Kaishita et al. | 241/DIG. 17 X |
| 4,588,136 | 5/1986 | Homma | 241/DIG. 17 X |
| 4,589,599 | 5/1986 | Williams | 241/DIG. 17 X |

FOREIGN PATENT DOCUMENTS

| | | | |
|---|---|---|---|
| 120496 | 10/1984 | European Pat. Off. | 241/37.5 |

*Primary Examiner*—Timothy V. Eley
*Attorney, Agent, or Firm*—Terry M. Crellin

[57] ABSTRACT

Improvements are disclosed for ice shaving apparatus of the type including (a) an ice receiving chamber having a cylindrical, upstanding sidewall and a substantially flat floor, (b) an elongate opening in the floor, (c) an elongate blade having a knife edge projecting through the opening into the chamber, (d) a removable cover for the chamber and (e) means for moving ice placed in the chamber against the knife edge to cut shavings from the ice. The improvements comprise an elongate, blunt, blade guard which is positioned adjacent to the blade and is movably mounted for movement from a recessed position in which a leading edge of the blade guard is recessed beneath the knife edge of the blade to an extending position in which the leading edge projects at least to the knife edge of the blade to provide a guard for the knife edge. Additional improvements include an ice press which does not have spikes or sharp projections extending therefrom and an outer chamber surrounding a rotating inner ice chamber, with the outer chamber having at least one window therein and with the inner chamber having designs placed thereon which are visible through the window in the outer chamber.

14 Claims, 3 Drawing Sheets

ICE SHAVER APPARATUS

BACKGROUND OF THE INVENTION

1. Field of the Invention

The present invention relates to ice shaving apparatus used in a user's home for making shaved ice confections. In particular, the invention relates to improvements in such apparatus which provides safety features such that the apparatus can safely be used by children as well as adults.

2. State of the Art

Shaved and crushed ice confections have long been available at commercial establishments. The equipment used in the commercial field is heavy duty equipment which costs far more than can be justified for home use. Low cost apparatus for shaving ice has recently been offered, but the apparatus has had serious safety drawbacks, especially when used by children as well as adults, or the apparatus has been in essence a toy which is only marginally functional if at all.

None of the prior art ice shavers have had any protection provided against the sharp blade of the cutting or shaving unit. The cutting blade is exposed whenever the top of the apparatus is removed, such as when adding ice to the apparatus. The exposed cutting blade can be contacted by the fingers of the user, and such apparatus has not been approved for use by children especially. In addition, the prior art ice shavers have utilized sharp pointed projectiles extending from the dasher or ice press to engage the ice and move the ice against the cutting blade. These sharp pointed projectiles are also exposed when the cover is removed from the apparatus and become dangerous spikes which can injure the person using the apparatus.

3. Objectives

A principal objective of the invention is to provide a relatively inexpensive ice shaving apparatus for use at home by children as well as adults, wherein a novel blade guard is provided which is automatically activated when the cover of the apparatus is removed and withdrawn when the cover is replaced.

Another objective of the present invention is to provide such an improved ice shaving apparatus further having a secondary locking mechanism which locks the blade guard in its active position whenever the cover is removed from the apparatus.

A further objective of the present invention is to provide an improved ice shaving apparatus having a novel dasher and rotatable ice chamber, wherein the dasher does not have spikes or pointed projections for engaging ice in the ice chamber, but rather the dasher and rotatable ice chamber have blunt ribs which engage the ice in the ice chamber.

Yet another objective of the present invention is to provide an improved ice shaving apparatus in which the ice chamber is formed by an inner chamber which rotates within an outer chamber, and at least one transparent window is provided in the outer chamber such that designs on the outer face of the inner chamber are visible through the window, with the designs rotating past the window as the inner chamber rotates.

BRIEF DESCRIPTION OF THE INVENTION

The above objectives are achieved in accordance with the present invention by providing an improvement in an ice shaving apparatus of the otherwise conventional type including (a) an ice receiving chamber having a cylindrical, upstanding sidewall and a substantially flat floor, (b) an elongate opening in the floor, (c) an elongate blade having a knife edge projecting through the opening into the chamber, (d) a removable cover for the chamber and (e) means for moving ice placed in the chamber against the knife edge to cut shavings from the ice. In a preferred embodiment of the present invention, the improvement comprises an elongate, blunt, blade guard positioned adjacent to the blade of the ice shaving apparatus. The blade guard is movably mounted beneath the opening in the floor of the ice receiving chamber and moves from a recessed position in which a leading edge of the blade guard is recessed beneath the knife edge of the blade to an extending position in which the leading edge extends through the opening in the floor of the ice receiving chamber. The extending blade guard projects into the ice receiving chamber at least by the same distance as the knife edge of the blade projects into the ice receiving chamber. The extending blade guard provides a protective shield for the knife edge.

Biasing means, such as a spring, are provided for forcing the blade guard to its extending position whenever the top of the apparatus has been removed to expose the knife edge of the blade in the ice receiving chamber. Means are provided in combination with the cover for depressing the blade guard to its recessed position when the cover is properly positioned on the apparatus so as to close the ice containing chamber. Thus, whenever the cover of the apparatus is removed, the blade guard is automatically moved to an elevated position in which it forms a shield and positively blocks contact with the sharp knife edge in the ice receiving chamber. The apparatus becomes safe enough for use even by children.

In an additional, preferred embodiment of the invention, an improved dasher or ice press is provided which does not have any spikes or sharp projections extending therefrom. Thus, when the cover of the apparatus is removed and the dasher or ice press is removed, there is nothing exposed which can cut or puncture the person using the apparatus. The dasher or ice press, in accordance with the present invention, comprises a substantially flat circular disk. A crank handle is attached to the dasher and extends from the top of the cover s that the dasher can be turned in the ice receiving chamber. An elongate, raised, blunt slat is affixed to and extends across the face of the dasher to engage ice in the ice receiving chamber.

The sidewall of the ice receiving chamber preferably rotates about its cylindrical axis. At least two elongate, raised, blunt bars are provided on the inside surface of the sidewall of the ice receiving chamber. The slat on the face of the dasher preferably extends slightly beyond the periphery of the dasher, with these extending ends engaging the respective bars on the sidewall of the ice receiving chamber. As the dasher rotates it drives the sidewall of the ice receiving chamber at a rotational speed which is the same as the rotational speed of the dasher. The slat on the dasher and the bars on the sidewall of the ice receiving chamber engage ice in the chamber and move the ice against the knife edge of the blade to cut shavings from the ice.

In a further preferred embodiment of the invention, an outer cylindrical chamber circumscribes the sidewall of the ice receiving chamber. The outer cylindrical chamber has at least one window area therein which is transparent such that the sidewall of the ice receiving chamber is visible through the window. Various designs can be formed on the outer surface of the sidewall of the ice receiving chamber, whereby when the sidewall rotates, the moving designs or patterns can be see through the transparent window or windows in the outer chamber.

Additional objects and feature of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

Figure 1:
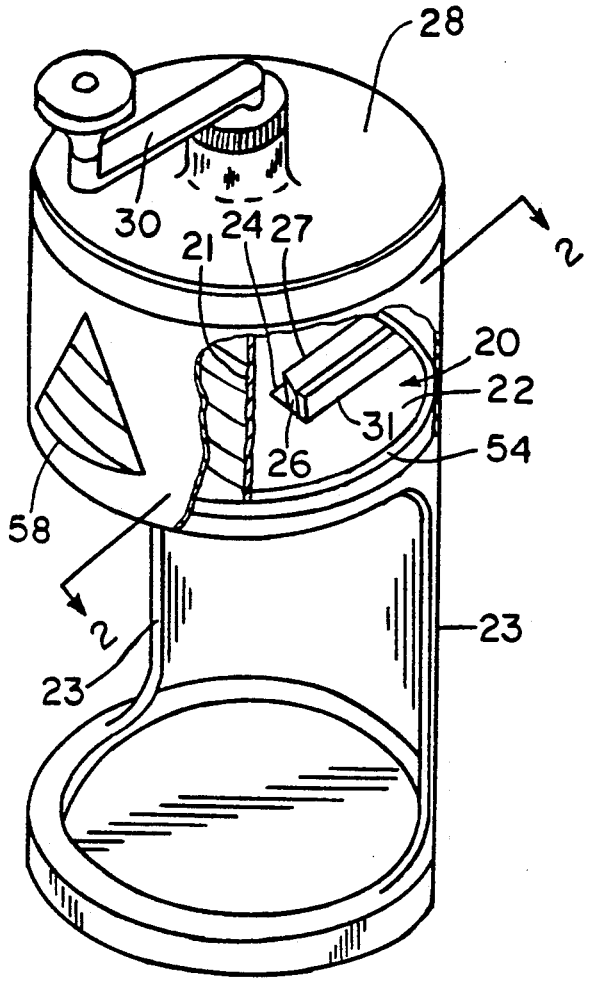
FIG. 1 is a pictorial representation of an ice shaving apparatus incorporating the novel improvements of the present invention.

As mentioned previously, the present invention involves an improvement in otherwise conventional ice shaving apparatus. A preferred embodiment of ice shaving apparatus incorporating novel improvements of the present invention is shown in the drawings. The basic ice shaving apparatus comprises an ice receiving chamber 20 having a cylindrical, upstanding sidewall 21 and a substantially flat floor 22. As illustrated, the ice receiving chamber 20 is positioned on a pedestal 23 and the floor 22 of the ice receiving chamber 20 is formed by the top surface of the pedestal 23. The sidewall of the pedestal 23 is cut away to provide access for a cup or other container to collect ice shavings beneath the ice receiving chamber 20.

An elongate opening 24 is provided in the floor 22, and an elongate, substantially planar blade 26 having a knife edge 27 projects through the opening 24 into the ice receiving chamber 20. The apparatus has a removable cover 28 for the ice receiving chamber 20, and a dasher or ice press 29 and a crank handle 30 are associated with the cover 28 for moving ice placed in the chamber 20 against the knife edge 27 to cut shavings from the ice. The shaved ice falls through the opening 24 into a container placed below the opening. The items identified by reference numerals 20-30 above are all well known in the art.

The present invention comprises improvements in ice shaving apparatus of the type illustrated, wherein an elongate, blunt, substantially planar, blade guard 31 is positioned adjacent to the blade 26, with the blade guard 26 being movably mounted beneath the opening 24 in the floor 22 of the ice receiving chamber 20. The blade guard comprises a substantially planar plate or slab which slides flatwise along the blade 26 for movement from a recessed position in which a leading edge of the blade guard 31 is recessed beneath the knife edge 27 of the blade 26 to an extending position in which the leading edge of the blade guard 31 extends through the opening 24 in the floor 22 of the ice receiving chamber 20 to project into the chamber 20 at least by the same distance as the knife edge 27 of the blade 26 projects into the chamber 20. When in its projecting position, the blade guard 31 provides a physical barrier barring access to the knife edge 27 of the blade 26.

To be effective, the blade guard 31 must be forced into its extending position anytime that the cover 28 is removed from the ice shaving apparatus. A spring 32 (see FIG. 4) is provided to bias the blade guard 26 to its extending position. Means associated with the cover 28 are provided for depressing the blade guard 26 against the biasing action of the spring 32 to its recessed position below the knife edge 27 when the cover 28 is properly positioned on the apparatus to close the ice containing chamber 20.

As illustrated, there is further provided an outer cylindrical chamber 33 circumscribing the cylindrical sidewall 21 of the ice receiving chamber 20, and engagement means, which will be described more full below, are associated with an upper edge of the outer chamber 33 for mounting the cover 28 in its proper operable position closing the ice receiving chamber 20. The means for depressing the blade guard 31 comprises an elongate, push rod 34 positioned within the space between the sidewall of the outer chamber 33 and the sidewall 21 of the ice receiving chamber 20. The push rod 34 extends upwardly in the outer chamber 33, and the end of the push rod 34 extends through an opening in the floor 22 or top of the pedestal 23 and is attached to the blade guard 31 at a position beneath the floor 22 of the ice receiving chamber 20. When the push rod 34 is pushed at its upper end, the blade guard 31 is moved against the biasing force of spring 32 to its recessed position thereby exposing the knife edge 27 of blade 26.

Figure 7:
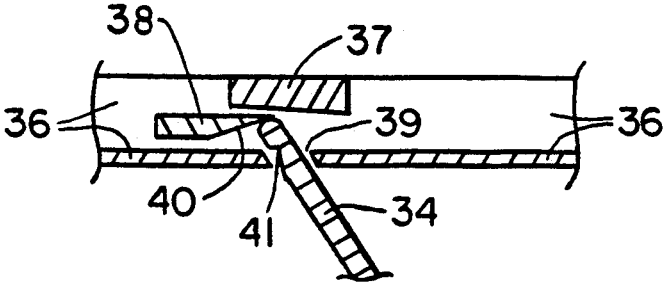
FIG. 7 is a partial cross section taken along line 7-7 of FIG. 2 and showing the interaction between the cam-shaped lugs of the cover and the pusher rod of the blade guard.
Figure 8:
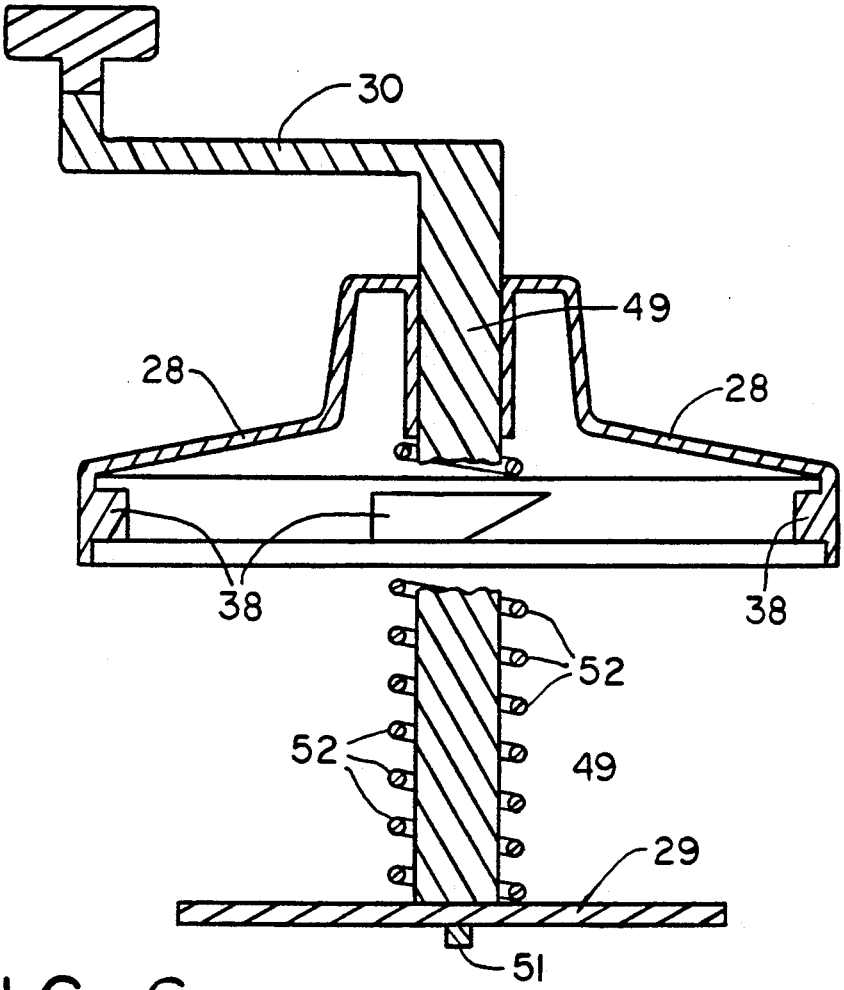
FIG. 8 is a vertical cross section through the cover and associated crank shaft and dasher or ice press.
Figure 6:
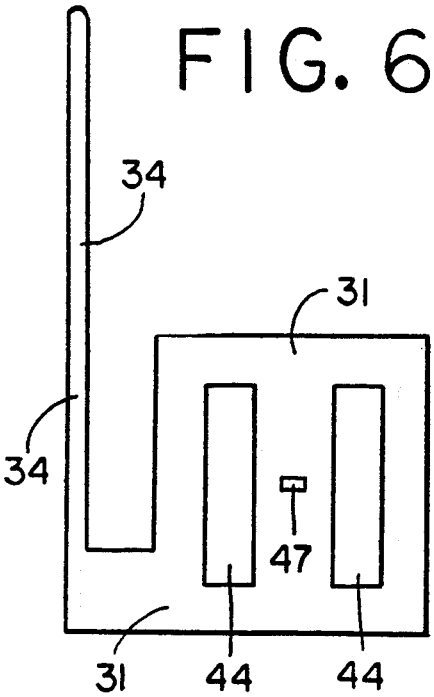
FIG. 6 is a vertical elevation of the blade guard and pusher rod.

Of course, means, must be provided on the cover 28 for engaging and pushing the upper end of the push rod 34 when the cover 28 makes engagement with the engagement means at the upper edge of the outer chamber 33. The engagement means preferably comprises a locking ring 36 attached to the upper edge of the outer chamber 33. The locking ring 36 has lugs 37 which interlock with corresponding lugs 38 on the cover 28. There is also provided an opening 39 in the locking ring 36, with the upper end of the push rod 34 extending through the opening 39. The means for pushing the upper end of the push rod 34 comprises a cam surface on the lugs 38 of the cover 28. As best shown in FIG. 7, the cam surface 40 on lugs 38 pushes the upper end of the push rod 34 downwardly as the cover 28 is turned to interlock the lugs 38 on the cover 28 with the lugs on the locking ring 36.

It is advantageous to provide a secondary locking system for locking the blade guard 31 in its extending position when the cover 28 is removed from the apparatus. The secondary locking system, as shown in FIG. 7, comprises a notch 41 in the side of the upper end of the push rod 34. The notch 41 engages an upper edge portion of the opening 39 in the locking ring 36 when the cover 28 is disengaged from the locking ring 36 and the blade guard 31 slides t its extending position thereby moving the push rod 34 toward the locking ring 36. As shown in FIG. 7, the cam surface 40 of the lugs 38 on the cover 28 deflects the upper end of the push rod 34 to disengage the notch 41 from the upper edge portion of the opening 39 in the locking ring 36 as the cover 28 is properly placed on the apparatus.

The push rod 34 is preferably canted at a slight angle as shown in FIG. 7 to aid the cam surface 40 of the lugs 38 in disengaging the notch 41 from the opening 39. In addition, the opening 39 is located such that stress is provided in the elongate push rod 34 so as to bias the side of the push rod 34 containing the notch 41 into firm engagement with the opening 39. Thus, when the cover 28 is removed and the push rod 343 moves upwardly under the biasing force of spring 32, the notch 41 is forced into positive engagement with the upper edge portion of the opening 39.

Figure 5:
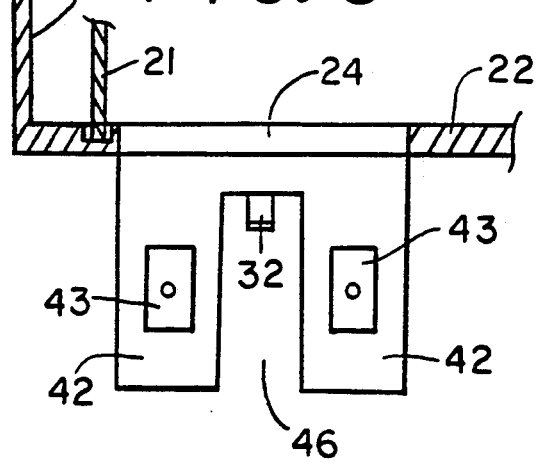
FIG. 5 is a partial cross section through the cutter blade mechanism as taken along line 5-5 of FIG. 2.
Figure 3:
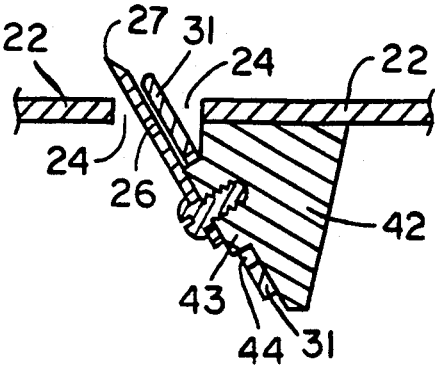
FIG. 3 is a partial cross section through the cutter blade mechanism of the apparatus as taken along line 3—3 of FIG. 2.
Figure 4:
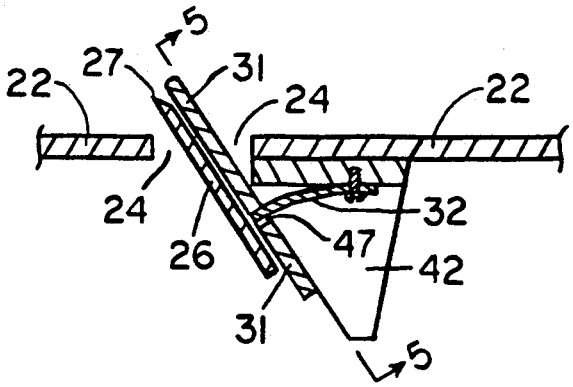
FIG. 4 is a partial cross section similar to that of FIG. 3 but taken along line 4—4 of FIG. 2.

A preferred means of mounting the blade 26 and blade guard 31 is illustrated in FIGS. 3–5. The blade 26 is mounted to a mounting block 42 which is positioned below the opening 24 in the floor 22 of the ice receiving chamber 20. The mounting block 42 has two mounting pads 43 extending therefrom with the blade 26 being mounted on the mounting pads 43. The blade guard 31 is a rectangular plate whose thickness is no greater than the distance which the mounting pads 43 extend from the mounting block 42. The blade guard 31 further has two elongate openings 44 formed therein with the openings 44 fitting over the mounting pads 43 of the mounting block 42 so that the blade guard 31 is positioned flatwise between the blade 26 and the mounting block 42 for sliding movement of the blade guard 31 between the blade 26 and the mounting block 42.

Preferably, each of the mounting pads 43 have parallel opposite sides, and each of the openings 44 in the blade guard 31 have opposite parallel sides which slide along mutually respective parallel sides of the mounting pads 43. As best illustrated in FIGS. 4 and 5, a central cavity 46 is formed in the midpoint of the mounting block 42. The cavity 46 is formed between the mounting pads 43 of mounting block 42. The cavity 46 accommodates the spring 32 which produces the upward biasing force on the blade guard 31. As shown, the spring 32 is mounted at one of its ends to the upper surface of the cavity 46, and the other end of the spring 32 engages an opening 47 in the blade guard 31.

An improvement in the dasher or ice press 29 is also provided for the ice shaving apparatus shown in the drawings. The ice press 29 itself comprises a substantially flat, circular disk which is received in the ice receiving chamber 20. A shaft 49 extends from the ice press 29 through the cover 28, and a crank handle 30 is attached to the extending end of the shaft 49 for turning the ice press 29. The improvement in the ice press in accordance with the present invention comprises an elongate, raised, blunt slat 51 which is attached to and extends across the face of the circular ice press. The blunt slat 51 and the circular ice press 29 engage ice in the ice receiving chamber 20 and move the ice against the knife edge 27 to cut shavings from the ice. A coiled spring 52 is advantageously provided around the shaft 49 between the cover 28 and the ice press 29 to bias the ice press downwardly into contact with the ice in the ice receiving chamber 20.

In the illustrated embodiment of the improved ice shaving apparatus the floor 22 of the ice receiving chamber 20 has a cylindrical groove 54 therein, and the lower edge of the sidewall 21 of the ice receiving chamber 20 is received in the cylindrical groove 54 for rotational movement of the sidewall 21, with the cylindrical groove 54 forming a guide track in which the sidewall 21 moves.

Figure 9:
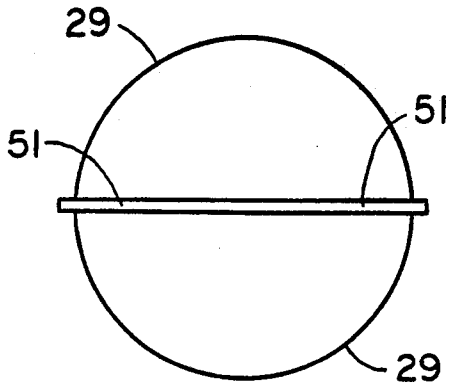
FIG. 9 is a bottom view of the ice engaging face of the dasher or ice press.
Figure 10:
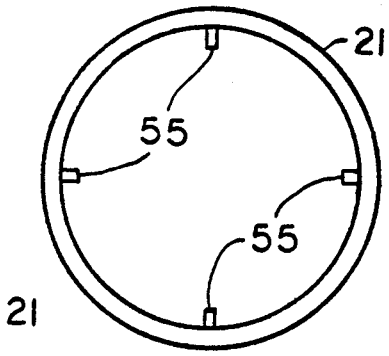
FIG. 10 is a top view of the cylindrical sidewall forming the ice receiving chamber of the apparatus of FIG. 1.
Figure 2:
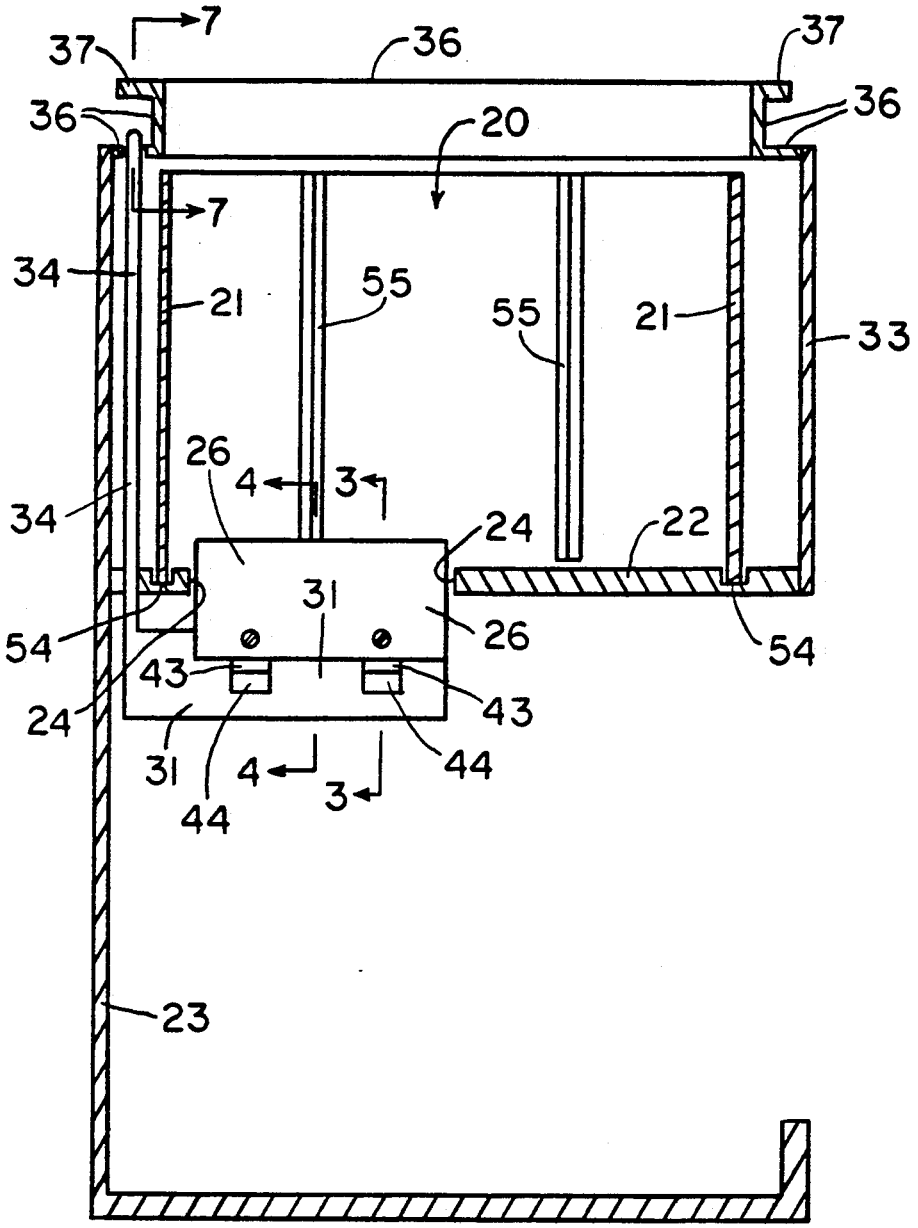
FIG. 2 is a vertical cross section taken on line 22 of FIG. 1.

As shown in FIGS. 2 and 9, at least two elongate, raised, blunt bars 55 (four such bars shown in the drawings) are provided on the inside surface of the sidewall 21 of the ice receiving chamber 20. The blunt bars 55 extend downwardly from the top edge of the sidewall 21, but stop short of the lower edge of the sidewall 21 to allow the lower edge of the sidewall 21 to ride in the groove 54 in the floor 22 of the ice receiving chamber 20.

The ends of the blunt slat 51 on the ice press 29 extend slightly from the periphery of the ice press 29 to engage the blunt bars 55 on the inside surface of the sidewall 21 of the ice receiving chamber 20 so as to rotate the sidewall 21 as the ice press 29 rotates. The rotating sidewall 21 and the blunt bars 55 thereon aid in moving the ice in the ice receiving chamber 20 against the knife edge 27.

A further improvement in ice shaving apparatus as illustrated comprises at least one window 58 in the outer cylindrical chamber 33. The window 58 is transparent so that the sidewall 21 of the ice receiving chamber 20 can be seen through the window 58. Designs can be placed on the sidewall 21 of the ice receiving chamber 20 such that the designs are visible through the window 58 in the outer cylindrical chamber 33. In the embodiment shown in the drawings, the design on the sidewall 21 is basically a barber pole. As the sidewall 21 rotates, the barber pole markings move through the window 58. Any design, of course, can be placed on the sidewall 21 instead of the barber pole design as illustrated in the drawings.

Although preferred embodiments of the improvements in the ice shaving apparatus of the present invention have been illustrated and described, it is to be understood that the present disclosure is made by way of example and that various other embodiments are possible without departing from the subject matter coming within the scope of the following claims, which subject matter is regarded as the invention.

I claim:

1. An improvement in ice shaving apparatus of the type including (a) an ice receiving chamber having a cylindrical, upstanding sidewall and a substantially flat floor, (b) an elongate opening in said floor, (c) an elongate blade having a knife edge projecting through said opening into said chamber, (d) a removable cover for said chamber and (e) means for moving ice placed in said chamber against said knife edge to cut shavings from said ice, said improvement comprising an elongate, blunt, blade guard positioned adjacent to said blade, said blade guard being movably mounted beneath said opening in said floor of said chamber for movement from a recessed position in which a leading edge of said blade guard is recessed beneath the knife edge of said blade to an extending position in which the leading edge extends through said opening in said floor of said chamber to project into said chamber at least to the same distance as said knife edge of said blade projects into said chamber and to thereby provide a guard for said knife edge, means for biasing said blade guard to its extending position; and means for depressing said blade guard to its recessed position when said cover is positioned on said ice containing chamber.

2. An improvement in ice shaving apparatus as claimed in claim 1, wherein there is further provided an outer cylindrical chamber circumscribing the cylindrical sidewall of said ice receiving chamber;

engagement means associated with an upper edge of said outer chamber for mounting said cover in an operable position over said ice receiving chamber; and said means for depressing said blade guard comprises an elongate, push rod positioned within the outer chamber, with an upper end of said push rod extending upwardly in said outer chamber and with a lower end of said push rod being associated with said blade guard beneath said floor of said ice receiving chamber, such that when the push rod is pushed at its upper end, the blade guard is moved to its recessed position; and means on said cover for engaging and pushing the upper end of said push rod when the cover is in engagement with said engagement means 3. An improvement in ice shaving apparatus as claimed in claim 2, wherein said engagement means comprises a locking ring attached to the upper edge of said outer chamber, said locking ring having lugs which interlock with corresponding lugs on said cover, and further wherein there is an opening in said locking ring, with the upper end of said push rod extending through said opening, with said means for depressing said blade guard comprising a cam member associated with said cover which pushes the upper end of said push rod downwardly as the lugs on said cover interlock with the lugs on said locking ring.

4. An improvement in ice shaving apparatus as claimed in claim 3, wherein a secondary locking system is provided for locking the blade guard in its extending position when the cover is removed from the apparatus, said secondary locking system comprising a notch in the side of the upper end of said push rod wherein said notch engages an upper edge portion of the opening in said locking ring when the cover is disengaged from said locking ring so that the blade guard is biased to its extending position thereby moving the push rod in a direction toward said locking ring, and further wherein said cam member deflects the upper end of said push rod to disengage said notch from said upper edge portion of the opening in the locking ring as the cover is replaced on the apparatus.

5. An improvement in ice shaving apparatus as claimed in claim 2, wherein the outer cylindrical chamber has at least one window area therein which is transparent such that the sidewall of the ice receiving chamber can be seen through the window.

6. An improvement in ice shaving apparatus as claimed in claim 5, wherein the ice receiving chamber rotates about its cylindrical axis, and designs are placed on the sidewall of said ice receiving chamber such that said designs can be seen through said window in said outer cylindrical chamber.

7. An improvement in ice shaving apparatus as claimed in claim 1, wherein said blade is mounted to a mounting block which is positioned below said opening in said floor of said ice receiving chamber;

the mounting block has two mounting pads extending therefrom with said blade being mounted on said mounting pads;

said blade guard is a rectangular plate whose thickness is no greater than the distance which the mounting pads extend from said mounting block, said blade guard further having two elongate openings formed therein with the openings in said blade guard fitting over said mounting pads of said mounting block so that the blade guard is positioned between the blade and the mounting block for sliding movement of the blade guard between the blade and the mounting block.

8. An improvement in ice shaving apparatus as claimed in claim 7, wherein each of said mounting pads have parallel opposite sides, and each of the openings in said blade guard have opposite parallel sides which slide along mutually respective parallel sides of said mounting pads.

9. An improvement in ice shaving apparatus as claimed in claim 1, wherein a substantially flat, circular dasher is received in the ice receiving chamber with a shaft extending from the dasher through the cover;

a crank handle is attached to the extending end of said shaft for turning said dasher; and an elongate, raised, blunt slat is attached to and extends across the face of said circular dasher, wherein the blunt slat and the circular dasher engage ice in said ice receiving chamber and move the ice against said knife edge to cut shavings from said ice.

10. An improvement in ice shaving apparatus as claimed in claim 9, wherein a coiled spring is provided around said shaft between said cover and said dasher to bias the dasher downwardly into contact with the ice in said ice receiving chamber.

11. An improvement in ice shaving apparatus as claimed in claim 9, wherein said floor of said ice receiving chamber has a cylindrical groove therein and the lower edge of the sidewall of said ice receiving chamber is received in said cylindrical groove such that said cylindrical groove forms a guide track in which said sidewall of said ice receiving chamber can rotate;

at least two elongate, raised, blunt bars are provided, on the inside surface of said sidewall of said ice receiving chamber, with the blunt bars extending downwardly from the top edge of said sidewall; and the ends of said blunt slat on said dasher extend from the periphery of said dasher to engage the blunt bars on the inside surface of said sidewall of said ice receiving chamber to rotate said sidewall as said dasher rotates, and wherein said rotating sidewall and blunt bars thereon aid in moving the ice in said ice receiving chamber against said knife edge.

12. An improvement in an ice shaving apparatus of the type including (a) an ice receiving chamber having a cylindrical, upstanding sidewall and a substantially flat floor, (b) an elongate opening in said floor, (c) an elongate blade having a knife edge projecting through said opening into said chamber, (d) a removable cover for said chamber and (e) means for moving ice placed in said chamber against said knife edge to cut shavings from said ice, said improvement comprising a substantially flat, circular dasher is received in the ice receiving chamber with a shaft extending from the dasher through the cover;

a crank handle is attached to the extending end of said shaft for turning said dasher; and an elongate, raised, blunt slat is attached to and extends across the face of said circular dasher, wherein the blunt slat and the circular dasher engage ice in said ice receiving chamber and move the ice against said knife edge to cut shavings from said ice.

13. An improvement in ice shaving apparatus as claimed in claim 12, wherein a coiled spring is provided around said shaft between said cover and said dasher to bias the dasher downwardly into contact with the ice in said ice receiving chamber.

14. An improvement in ice shaving apparatus as claimed in claim 12, wherein said floor of said ice receiving chamber has a cylindrical groove therein and the lower edge of the sidewall of said ice receiving chamber is received in said cylindrical groove such that said cylindrical groove forms a guide track in which said sidewall of said ice receiving chamber can rotate;

at least two elongate, raised, blunt bars are provided on the inside surface of said sidewall of said ice receiving chamber, with the blunt bars extending downwardly from the top edge of said sidewall; and the ends of said blunt slat on said dasher extend from the periphery of said dasher to engage the blunt bars on the inside surface of said sidewall of said ice receiving chamber to rotate said sidewall as said dasher rotates, and wherein said rotating sidewall and blunt bars thereon aid in moving the ice in said ice receiving chamber against said knife edge.

* * * * *